US012441569B2

(12) United States Patent
Blok

(10) Patent No.: US 12,441,569 B2
(45) Date of Patent: Oct. 14, 2025

(54) VARIABLE TENSION FILM DISPENSER WITH LOCKING FEATURE

(71) Applicant: Johannes Blok, Buffalo, NY (US)

(72) Inventor: Johannes Blok, Buffalo, NY (US)

(73) Assignee: GLOBAL FILM SOURCE LLC, Edison, NJ (US)

( * ) Notice: Subject to any disclaimer, the term of this patent is extended or adjusted under 35 U.S.C. 154(b) by 159 days.

(21) Appl. No.: 18/195,465

(22) Filed: Oct. 11, 2023

(65) Prior Publication Data

US 2025/0122044 A1 Apr. 17, 2025

(51) Int. Cl.
*B65H 23/08* (2006.01)
*B65H 16/00* (2006.01)
*B65H 75/30* (2006.01)

(52) U.S. Cl.
CPC ..... *B65H 23/085* (2013.01); *B65H 16/005* (2013.01); *B65H 75/30* (2013.01); *B65H 2701/1842* (2013.01)

(58) Field of Classification Search
CPC .... B65H 23/085; B65H 16/005; B65H 75/30; B65H 2701/1842; B65H 2403/72
USPC ..... 242/422, 422.4, 422.9
See application file for complete search history.

(56) References Cited

U.S. PATENT DOCUMENTS 4,477,037 A 10/1984 Goldstein
4,484,717 A 11/1984 Goldstein
4,575,020 A 3/1986 Strout et al.
4,706,442 A * 11/1987 Riemenschneider ..... B65B 67/085 242/588.2
4,752,045 A * 6/1988 Goldstein ..... B65B 67/085 242/588.2
4,784,348 A 11/1988 McDonald
4,872,623 A * 10/1989 Parry ..... B65B 67/085 242/588
5,203,517 A 4/1993 Perry et al.
5,915,642 A 6/1999 Davis
7,380,744 B1 * 6/2008 Yu Chen ..... B65H 75/185 242/422.4
9,272,870 B2 3/2016 Stanton
D823,905 S 7/2018 Walters et al.
11,203,509 B2 * 12/2021 Conrad ..... B65H 16/005
11,584,610 B2 2/2023 Conrad et al.
2009/0308968 A1 12/2009 Piotrowski et al.
2010/0044491 A1 * 2/2010 Ritchey ..... A61F 15/005 242/422.4
2012/0181369 A1 7/2012 Blok
2012/0217336 A1 * 8/2012 Yu Chen ..... B65B 67/085 242/423
2013/0074446 A1 3/2013 Windheuser
2014/0116004 A1 5/2014 Pace
2015/0183542 A1 7/2015 Blok
2016/0264277 A1 9/2016 Dahlmann et al.
2016/0289033 A1 10/2016 Love et al.
2021/0014717 A1 1/2021 Xiang
2021/0147174 A1 * 5/2021 Conrad ..... B65H 37/005

FOREIGN PATENT DOCUMENTS

DE 20 2004 011 730 * 11/2004

* cited by examiner

*Primary Examiner* — William A. Rivera
(74) *Attorney, Agent, or Firm* — WEISS & WEISS

(57) ABSTRACT

A variable tension control film dispenser with a locking mechanism that is manually activated by squeezing pressure on the outside of the skin against a mandrel or extended core.

18 Claims, 5 Drawing Sheets

VARIABLE TENSION FILM DISPENSER WITH LOCKING FEATURE

FIELD OF THE INVENTION

The present invention relates to a variable tension control film dispenser with a locking mechanism that is manually activated by squeezing pressure on the outside of the skin.

BACKGROUND OF THE INVENTION

Stretch wrap is used in many applications, including securing loads on a pallet, wrapping products to protect them from damage, and bundling various items together. Typically, a roll of stretch wrap is made up of a core (usually made of paperboard) around which the plastic wrap is wound. Coreless versions exist where the film is wound around itself without an inner core.

To facilitate applying the film by hand, the core in the film roll may be extended beyond the film edge (extended core), or a mandrel can be inserted inside the roll to enable the operator to unwind the film. However, it is difficult to control the film tension when wrapping items with these products.

Most of the prior art designs rely on either regulating friction between an extended core and an outside skin, or by regulating the friction between a mandrel, which is wedged in the core, and an outside skin. Regulating friction is done by varying the amount of squeezing action by the hand on the outside surface.

A problem with dispensers is that they rely on friction alone to regulate tension in the film and that the amount of friction required to achieve a certain tension in the film is very different when the roll is large compared to when the roll is almost used up. As the roll diameter gets smaller, the friction required to stop the roll becomes proportionally smaller as well. The practical implication is that a design which is optimized for a larger roll diameter is not functional when the roll is almost used up. On the other hand, a dispenser design that is optimized for a small roll diameter requires an extraordinary amount of friction, and thus squeezing action, to stop the roll from unwinding when used with a larger diameter roll.

U.S. Pat. No. 4,477,037 relates to stretch wrap film wound on a mandrel or core which is longer than the roll of film to extend out both ends. A rotatable handle is mounted on the core outboard of the film. Braking between the handle and core is adjusted by a screw thread which tightens a friction brake.

U.S. Pat. No. 4,484,717 relates to a stretch wrap film on a roll utilized by manual grasp on handles mounted on each end of the roll and freely rotatable. A brake-ring is positioned under the index finger clamped onto a spindle running with stretch wrap film roll to apply braking.

U.S. Pat. No. 4,575,020 relates to a portable chuck dispensing under tension roll of wrap material wound on a tubular core, that includes expandable spindle insertable in one end of the tubular core. An adjustable brake through two pieces are squeezed together and through a fulcrum creates expanding collar inside the core.

U.S. Pat. No. 4,784,348 relates to a head and spindle projecting outwardly, with head mounting on a roll of web. A wrap envelope of web is wound about a spindle, tension and speed of unrolling the web is done by manually squeezing wrap envelope on the spindle causing the brake.

U.S. Pat. No. 5,203,517 relates to a dispenser for stretch wrap film having a spindle that forms a hub that attaches to a core of film roll, rotates with the roll as film is unwound.

The spindle extends coaxially from the core and partially surrounded by flexible hand grip. Bearings are beneath hand grip. Part of the hand grip engages spindle without bearings so hand pressure cause friction to brake.

U.S. Pat. No. 5,915,642 relates to handle having insert portion having plurality of radially extending fins and grip surface. Handle is inserted into a hollow core. Fins provide a fit allows core to rotate relative to the handle. The fins can deform when subjected to rotation. Grip positioned allows user to squeeze handle against core to slow or stop rotation. Fins extending outward from insert portion to be inserted into core and fingers to fit inside handle. Braking force is applied by repositioning fingers inside handle to deform fins against the core. Core is large enough to fit fingers inside.

U.S. Pat. No. 9,272,870 relates to a film dispensing apparatus that has an exterior holding surface of a holding member that is concentric with axis of rotation of rotating member. Film dispensing apparatus includes brake portion found in interior of holding member associated with interior holding surface with sufficient force, causes brake portion to flex and contact the rotating member to provide more tension.

U.S. Pat. No. 11,584,610 relates to rotating member for wrap dispenser, includes a first portion defining first outer surface and first inner surface, first inner surface define first inner diameter, second portion define second inner surface, second inner surface define second inner diameter; first inner diameter less than second inner diameter; an upset radially outwardly from first outer surface of first portion, upset oriented distal to second portion, slot extends longitudinally through upset allow upset flex inward.

US patent publication 20090308968 relates to dispenser for coreless rolls of film. Mandrels of dispenser can move between retracted position where dispenser has reduced diameter, when dispenser inserted in roll of film and increased diameter when film dispensed. Mandrel sections joined by spring configurations and slidable. Lug elements deflect spring configurations outwardly.

US patent publication 20120181369 relates to film dispenser for stretch wrap. Film dispenser comprised of separate inner and outer mold. Inner mold comprised of slots and extensions, and a collar which fits into outer mold, and inner ridges of inner mold fit into groove on extended core. Outer mold comprised of ribs which fit into slots of inner mold.

US patent publication 20130074446 relates to stretch film dispenser to wrap film up to 12" in width, consist of stopper ring secured at beginning of extended core followed by semi-compressible sleeve with embedded guide rings encircling core extension, contoured guide rings followed by second stripper ring secured one inch from remote end of core extension.

US patent publication 20140116004 relates to device for handling a roll of wrap material having tube handle, tube extension connected to tube handle, top end cap on tube handle, bottom end cap on tube extension, tensioning means, bottom end cap holds roll of wrapping on tube extension against tensioning means that is adjustable.

US patent publication 20150183542 relates to a film dispenser comprised of inner and outer mold. Inner mold comprised of slots and extensions, and a collar fits into outer mold, inner ridges of inner mold fit into groove on extended core. Outer mold comprised of ribs which fit into slots of inner mold.

US patent publication 20160264277 relates to dispenser include rotating member, holding member, collar at first end of holding member, inner surface enclosing engaging portion of rotating member, cap attached to end of rotating member and holding the holding member collar positioned between end surface at first end rotating member and stop surface of cap.

US patent publication 20160289033 relates to film dispenser for coreless film rolls. First dispenser member matable with second dispenser member, in at least two angular positions. Dispenser can engage film rolls of varying internal dimensions. Support walls define complementary interlocking formations. Engaged support walls support central region of film roll.

US patent publication 2021014717 relates to dispenser comprising rotating member and holding member. Diameter cylindrical inner surface of second portion greater than diameter of cylindrical inner surface of first portion. Plurality of ribs extend inwardly from cylindrical inner surface of second portion. Holding member located outwardly of first portion.

U.S. design Pat. 823,905 relates to a braking film dispenser with lobes.

SUMMARY OF THE INVENTION

The present invention relates to a system for stopping the release of wrapping material from a stretch wrap dispenser by using a locking mechanism.

It is an object of the present invention to use a combination of ridges or protrusions and slots that when in a fully locked position, instantly stop the roll, thus not relying on excessive squeezing force.

It is an object of the present invention for the stretch wrap dispenser to comprise a mandrel and a flexible skin, wherein the mandrel has slots and the flexible skin has protrusions.

It is an object of the present invention for the stretch wrap dispenser to comprise a mandrel and a flexible skin, wherein the mandrel has protrusions and the flexible skin has slots.

It is an object of the present invention for the stretch wrap dispenser to comprise a mandrel and a flexible skin, wherein the mandrel has protrusions and the flexible skin has protrusions. In this manner when trying to turn the dispenser, it will not turn when squeezed since the protrusions will make contact with each other.

It is an object of the present invention for the stretch wrap dispenser to comprise an extended core and a flexible skin, wherein the extended core has slots and the flexible skin has protrusions.

It is an object of the present invention for the stretch wrap dispenser to comprise an extended core and a flexible skin, wherein the extended core has protrusions and the flexible skin has slots.

It is an object of the present invention for the stretch wrap dispenser to comprise an extended core and a flexible skin, wherein the extended core has protrusions and the flexible skin has protrusions.

It is an object of the present invention for the mandrel and the flexible skin comprise a plastic material.

It is an object of the present invention for the extended core and the flexible skin to comprise a plastic material.

It is an object of the present invention for the extended core to be comprised of a paper material and the flexible skin to be comprised of a plastic material.

It is an object of the present invention for the stretch wrap dispenser to comprise at least two parts; a mandrel, which is solidly wedged into the core, and a flexible skin. It is an object of the present invention for the mandrel to comprise either ridges protruding outwardly longitudinally along the outside of the mandrel or slots protruding inwardly along the outside of the mandrel. It is an object of the present invention for the skin to exhibit protrusions longitudinally along the side of the skin, the position of which are laterally matched with the ridges or slots on the mandrel. By putting a minimum amount of squeezing action on the skin, the skin will deflect from a round shape into a slightly oval shape. This causes the protrusions on the inside of the skin to lock behind the ridges or latch into slots in the mandrel. With the mandrel being wedged inside of the film core, the locking mechanism will prevent the roll from unwinding any further. The present invention does not rely solely on friction, but is based on an interlocking mechanism.

It is an object of the present invention for the mandrel to have outward ridges and skin to have inward ridges.

It is an object of the present invention for the mandrel to have inward slots on the outside and the skin to have inward ridges to lock inside slots.

It is an object of the present invention for the mandrel to have outward ridges that will lock into inward slots on the inside of the skin.

It is an object of the present invention for the ridges to cover only part of the length of the mandrel and skin.

It is an object of the present invention for the part of the mandrel that is not covered by the ridges to have an idler made of a low friction plastic to facilitate easy unwinding when the skin is not being squeezed.

It is an object of the present invention for the ridges to cover the entire length of the part of the mandrel sticking outside the core and along the entire skin.

It is an object of the present invention for the mandrel to have a mandrel extension which when in use is wedged inside the core of the stretch wrap film.

It is an object of the present invention for the mandrel to have a flange which extends radially from the mandrel.

It is an object of the present invention for the flange to be locked into an undercut on the inside of the flexible skin to lock the film in place on the mandrel.

It is an object of the present invention for the flexible skin to have a textured surface to improve the grip of a user.

It is an object of the flexible skin to have a flange flaring out radially to protect a user's hand, located on the top side of the flexible skin.

DETAILED DESCRIPTION OF THE INVENTION

Figure 1A:
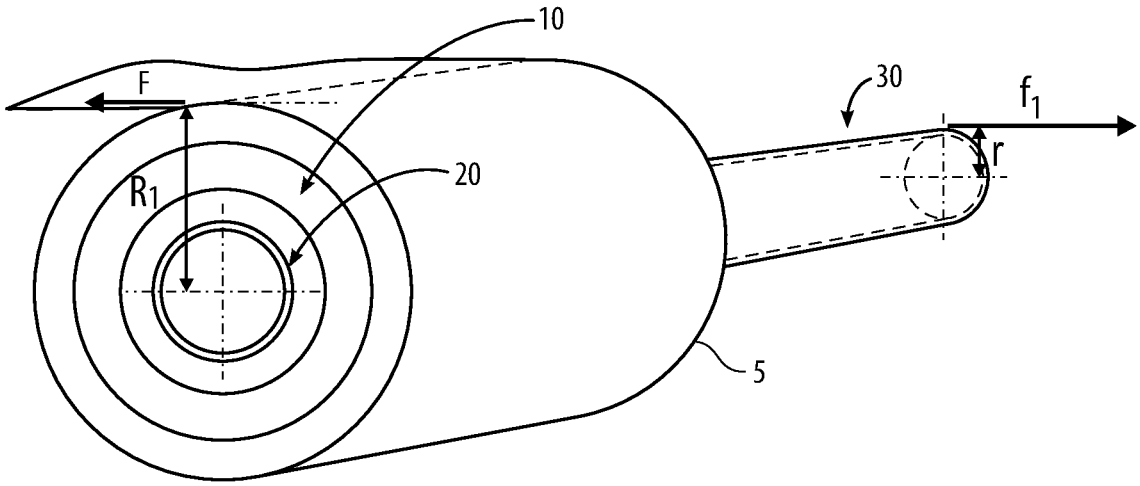
FIG. 1*a* shows a large diameter stretch wrap film roll.

FIG. 1*a* shows a large diameter stretch wrap film roll 5 having film layers 10, a film core 20 and a core extension 30.

Figure 1B:
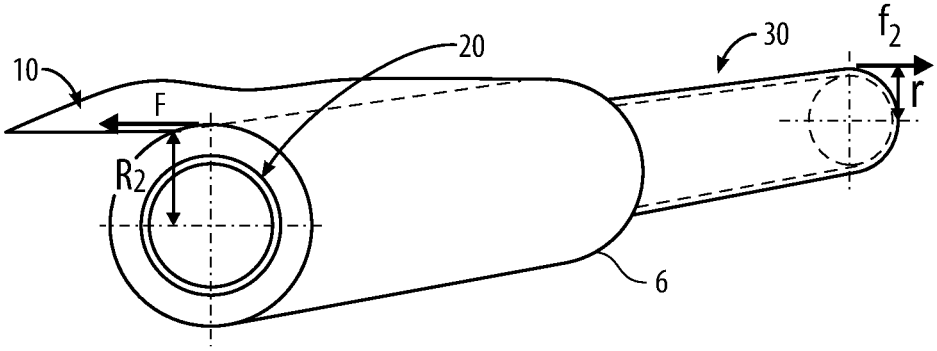
FIG. 1*b* shows a small diameter stretch wrap film roll.

FIG. 1*b* shows a small diameter stretch wrap film roll 6 having film layers 10, a film core 20 and a core extension 30.

Figure 2A:
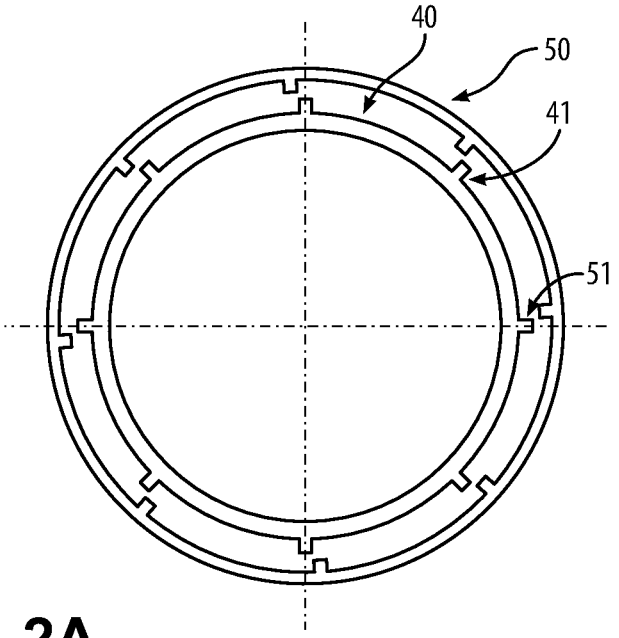
FIG. 2*a* shows a stretch wrap film roll in an unlocked position

FIG. 2*a* shows the device of the present invention in an unlocked position. The device has a mandrel 40 with ridges 41. The flexible outer skin 50 has ridges 51.

Figure 2B:
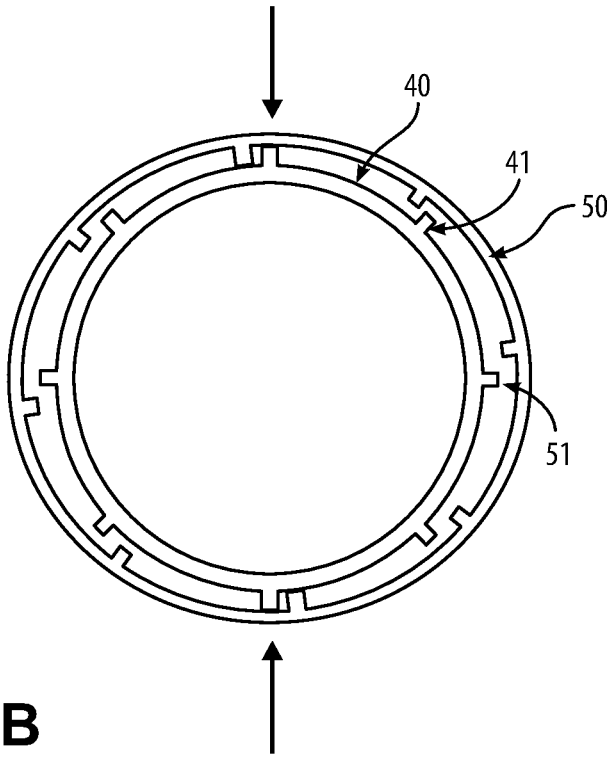
FIG. 2*b* shows a stretch wrap film roll in a locked position.

FIG. 2*b* shows the device of the present invention in a locked position caused by a user squeezing the flexible outer skin 50 against the mandrel 40. As shown in the figure, by squeezing the flexible outer skin 50, the ridges 51 on the flexible outer skin 50 make contact with the ridges 41 on the mandrel 40 causing the device to lock and prevent further movement.

Figure 3A:
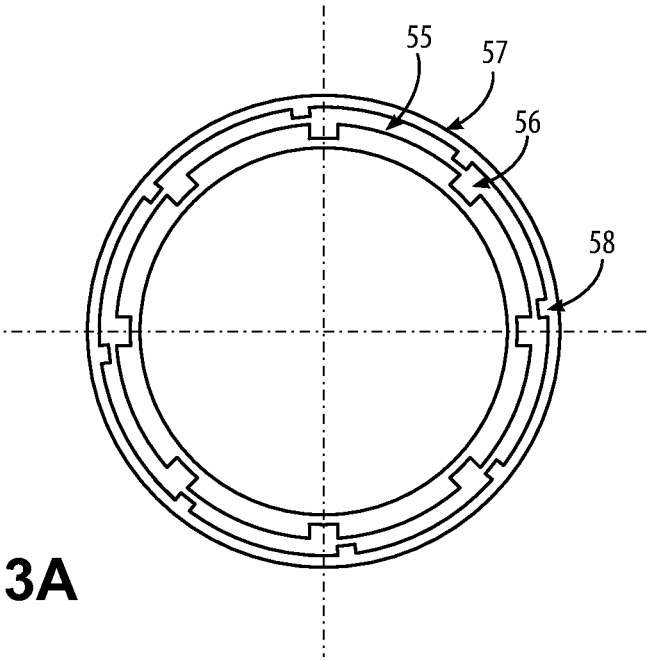
FIG. 3*a* shows a stretch wrap roll film in an unlocked position.

FIG. 3*a* shows the device of the present invention in an unlocked position. The device has a mandrel 55 with slots 56. The flexible outer skin 57 has ridges 58.

Figure 3B:
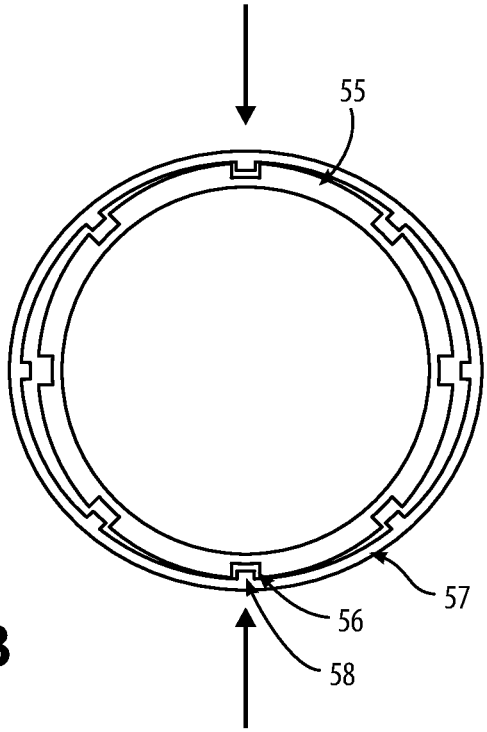
FIG. 3*b* shows a stretch wrap roll film in a locked position.

FIG. 3*b* shows the device of the present invention in the locked position caused by squeezing the flexible outer skin 57 against the mandrel 55. As shown in the figure, by squeezing the flexible outer skin 57, the ridges 58 on the flexible outer skin 57 make contact with the slots 56 on the mandrel 55 causing the device to lock and prevent further movement.

Figure 4:
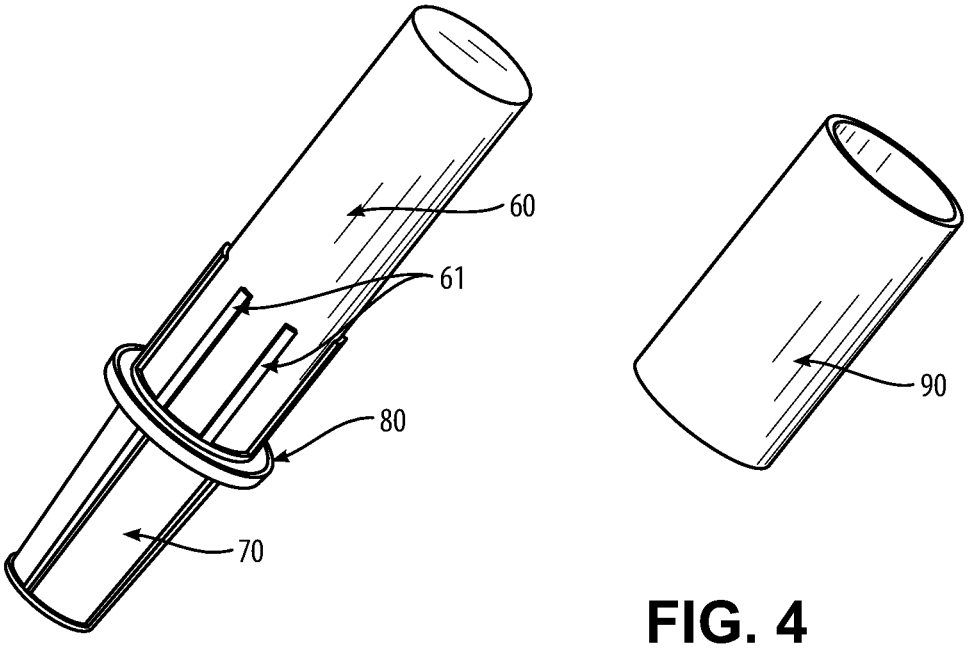
FIG. 4 shows a mandrel design with an idler of the present invention.

FIG. 4 shows the mandrel 60 having ridges 61. The ridges 61 along the length on the outside of the mandrel 60 may be partial or can extend all the way to the end of the mandrel 60. The mandrel 60 has a mandrel extension 70 which when in use is wedged inside the core. A flange 80 extends radially from the mandrel 60 and is located between the mandrel 60 and the mandrel extension 70. The flange 80 locks into the undercut 120 on the inside of the skin 100 shown in FIG. 5, to lock the skin 100 in place on the mandrel 60. An idler 90, which can be cylindrically shaped, is placed over the mandrel extension 70, which is not covered in ridges. The idler 90 may be made of a low friction material to improve the ease of unwinding when the skin is not being squeezed.

Figure 5:
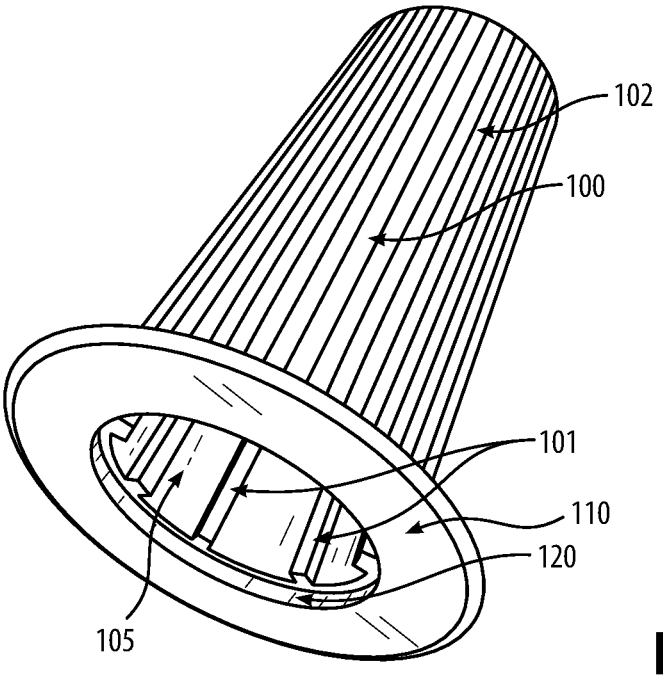
FIG. 5 shows a flexible skin design of the present invention.

FIG. 5 shows the flexible skin 100 having a textured surface 102 to improve the grip. The flexible skin 100 has ridges 101 located on the inside 105 of the flexible skin 100. The flexible skin 100 has a flange 110, flaring out radially to protect the hand, located on the top side of the flexible skin 100. There is an undercut 120 located on the inside of the flexible skin 100 below the flange 110. The undercut 120 receives the flange 80 of the mandrel 40.

Figure 6:
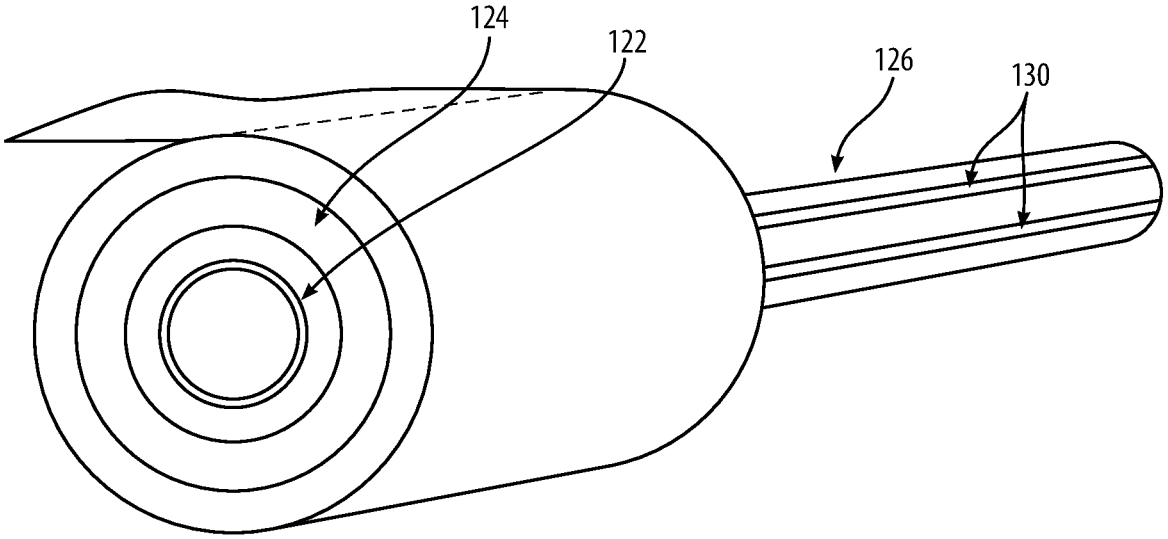
FIG. 6 shows a stretch wrap film roll with an extended core having slots.

FIG. 6 shows an film core 122 having film layers 124 wrapped around it. An extended core 126 extends beyond the film layers 124. Slots 130 are formed longitudinally in the extended core 126. The slots 130 are placed in the ridges 101 located on the inside 105 of the flexible skin 100 shown in FIG. 5.

With regards to the operation of the device, normally the skin will rotate freely around the mandrel. However, when the skin is being squeezed, the shape will become oval, thus starting to engage the ridges on the inside of the skin behind the ridges on the outside of the mandrel, and ultimately locking the skin on the mandrel which stops the film from unwinding any further.

The present invention teaches further methods of operating the device where the skin is locked onto the mandrel that includes slots on the inside of the skin engaging with ridges on the outside of the mandrel, or ridges located on the inside of the skin engaging with slots located on the outside of the mandrel. The invention further teaches any other type of protrusion on the inside of the skin engaging with matching slots in the outside of the mandrel, or protrusions on the outside of the mandrel engaging with matching slots on the inside of the skin.

The invention claimed is:

1. A device for stopping the release of a wrapping material film from a stretch wrap dispenser comprising:
- a flexible skin;
- a mandrel or extended core that is placed within said flexible skin;
- a locking mechanism that stops said release of said wrapping material film from said stretch wrap film dispenser;
- wherein one side of said mandrel is configured to be wedged inside a core of said stretch wrap film;
- a second side of said mandrel comprising ridges on outside along length of said mandrel;
- said flexible skin comprising ridges on inside of said skin that is configured to lock behind said ridges on said mandrel when said skin is squeezed creating said locking mechanism.

2. The device of claim 1 wherein said ridges are protrusions.

3. The device of claim 1 wherein said ridges cover only part of length of said mandrel and said skin.

4. The device of claim 1 further comprising an idler placed on outside of mandrel not containing ridges.

5. The device of claim 4 wherein said idler is made of low friction plastic to facilitate unwinding when said skin is not being squeezed.

6. The device of claim 1 wherein said flexible skin, and said mandrel or said extended core all are comprised of a plastic material.

7. The device of claim 1 wherein said flexible skin is textured.

8. The device of claim 1 wherein said mandrel comprises a flange that extends radially from said mandrel.

9. The device of claim 8 wherein said flange is locked into an undercut on inside of said flexible skin.

10. The device of claim 1 wherein said flexible skin comprises a flange that flares out radially, located on top side of said flexible skin.

11. A device for stopping the release of a wrapping material film from a stretch wrap dispenser comprising:
- a flexible skin;
- a mandrel or extended core that is placed within said flexible skin;
- a locking mechanism that stops said release of said wrapping material film from said stretch wrap film dispenser;
- wherein one side of said mandrel is configured to be wedged inside a core of a stretch wrap film;
- a second side of said mandrel comprising ridges on outside along length of said mandrel;
- said flexible skin comprising slots on inside of said skin that is configured to lock into said ridges on said mandrel when said skin is squeezed creating said locking mechanism.

12. The device of claim 11 wherein said ridges are protrusions.

13. The device of claim 11 wherein said slots and ridges cover only part of said mandrel and said skin.

14. The device of claim 11 further comprising an idler placed on outside of mandrel not containing ridges.

15. The device of claim 14 wherein said idler is made of low friction plastic to facilitate unwinding when said skin is not being squeezed.

16. A device for stopping the release of a wrapping material film from a stretch wrap dispenser comprising:
- a flexible skin;
- a mandrel or extended core that is placed within said flexible skin;

a locking mechanism that stops said release of said wrapping material film from said stretch wrap film dispenser;

wherein one side of said mandrel is configured to be wedged inside a core of a stretch wrap film;

a second side of said mandrel comprising slots on outside along length of said mandrel;

said flexible skin comprising ridges on inside of said skin that is configured to lock into said slots on said mandrel when said skin is squeezed to create a locking mechanism.

17. The device of claim 16 wherein said ridges are protrusions.

18. The device of claim 16 wherein said slots and ridges cover only part of said mandrel and said skin.

* * * * *